US010597819B2

(12) United States Patent
Nonni et al.

(10) Patent No.: US 10,597,819 B2
(45) Date of Patent: Mar. 24, 2020

(54) LOW VISCOSITY KRAFT FIBER HAVING REDUCED YELLOWING PROPERTIES AND METHODS OF MAKING AND USING THE SAME

(71) Applicant: GP Cellulose GmbH, Zug (CH)

(72) Inventors: Arthur J. Nonni, Peachtree City, GA (US); Charles E. Courchene, Snellville, GA (US); Phillip R. Campbell, Salisbury, CT (US); Steven C. Dowdle, Purvis, MS (US); Joel M. Engle, Purvis, MS (US)

(73) Assignee: GP Cellulose GmbH, Zug (CH)

( * ) Notice: Subject to any disclaimer, the term of this patent is extended or adjusted under 35 U.S.C. 154(b) by 0 days.

(21) Appl. No.: 15/984,038

(22) Filed: May 18, 2018

(65) Prior Publication Data

US 2018/0266051 A1 Sep. 20, 2018

Related U.S. Application Data

(62) Division of application No. 14/365,903, filed as application No. PCT/US2013/021224 on Jan. 11, 2013, now Pat. No. 10,000,890.

(60) Provisional application No. 61/585,833, filed on Jan. 12, 2012.

(51) Int. Cl.

| | |
|---|---|
| ***D21C 9/12*** | (2006.01) |
| ***D21C 3/26*** | (2006.01) |
| ***D21C 9/10*** | (2006.01) |
| ***D21C 9/16*** | (2006.01) |
| ***D01F 2/00*** | (2006.01) |
| ***D21H 11/04*** | (2006.01) |

(52) U.S. Cl.
CPC ..... *D21C 9/123* (2013.01); *D01F 2/00* (2013.01); *D21C 3/263* (2013.01); *D21C 9/1057* (2013.01); *D21C 9/163* (2013.01); *D21H 11/04* (2013.01)

(58) Field of Classification Search
None
See application file for complete search history.

(56) References Cited

U.S. PATENT DOCUMENTS

| | | | |
|---|---|---|---|
| 1,860,431 | A | 5/1932 | Richter |
| 2,112,116 | A | 3/1938 | Richter |
| 2,368,527 | A | 1/1945 | Edelstein |
| 2,749,336 | A | 6/1956 | Boddicker et al. |
| 2,978,446 | A | 4/1961 | Battista et al. |
| 3,728,331 | A | 4/1973 | Savage |
| 3,868,955 | A | 3/1975 | Steiger et al. |

(Continued)

FOREIGN PATENT DOCUMENTS

| | | |
|---|---|---|
| CA | 1129161 | 8/1982 |
| DE | 19620241 | 11/1997 |

(Continued)

OTHER PUBLICATIONS

Suchy et al., "Catalysis and Activation of Oxygen and Peroxide Delignification of Chemical Pulps; A Review," Miscellaneous Report, Pulp and Paper Research Institute of Canada, 1999, pp. 1-32.

(Continued)

*Primary Examiner* — Jacob T Minskey

(57) ABSTRACT

A bleached softwood kraft pulp fiber with high alpha cellulose content and improved anti-yellowing is provided. Methods for making the kraft pulp fiber and products made from it are also described.

11 Claims, 2 Drawing Sheets

(56) References Cited

U.S. PATENT DOCUMENTS

| | | | |
|---|---|---|---|
| 4,410,397 | A | 10/1983 | Kempf |
| 4,661,205 | A | 4/1987 | Ow et al. |
| H000479 | H | 6/1988 | Wood et al. |
| 5,302,248 | A | 4/1994 | Weinstock et al. |
| 5,346,589 | A | 9/1994 | Braunstein et al. |
| 5,447,602 | A | 9/1995 | Sajbel et al. |
| 5,522,967 | A | 6/1996 | Shet |
| 5,552,019 | A | 9/1996 | Weinstock et al. |
| 5,562,645 | A | 10/1996 | Tanzer et al. |
| 5,580,485 | A | 12/1996 | Feringa et al. |
| 5,593,543 | A | 1/1997 | Balos et al. |
| 5,630,906 | A | 5/1997 | Boe et al. |
| 5,639,348 | A | 6/1997 | Payton et al. |
| 5,703,225 | A | 12/1997 | Shet et al. |
| 5,853,428 | A | 12/1998 | Collins et al. |
| 5,876,625 | A | 3/1999 | Collins et al. |
| 5,994,531 | A | 11/1999 | Doenges et al. |
| 6,010,594 | A | 1/2000 | Henricson |
| 6,099,586 | A | 8/2000 | Collins et al. |
| 6,100,441 | A | 8/2000 | Blomstrom et al. |
| 6,136,223 | A | 10/2000 | Collins et al. |
| 6,146,494 | A | 11/2000 | Seger et al. |
| 6,210,801 | B1 | 4/2001 | Luo et al. |
| 6,214,976 | B1 | 4/2001 | Watanabe et al. |
| 6,221,209 | B1 | 4/2001 | Desprez |
| 6,221,487 | B1 | 4/2001 | Luo et al. |
| 6,228,126 | B1 | 5/2001 | Cimecioglu et al. |
| 6,235,154 | B1 | 5/2001 | Jiang |
| 6,235,392 | B1 | 5/2001 | Luo et al. |
| 6,241,779 | B1 | 6/2001 | Collins et al. |
| 6,306,334 | B1 | 10/2001 | Luo et al. |
| 6,319,361 | B1 | 11/2001 | Smith et al. |
| 6,331,354 | B1 | 12/2001 | Sealey, II et al. |
| 6,368,456 | B1 | 4/2002 | Cimecioglu et al. |
| 6,379,494 | B1 | 4/2002 | Jewell et al. |
| 6,398,908 | B1 | 6/2002 | Hermansson et al. |
| 6,432,266 | B1 | 8/2002 | Fukushima et al. |
| 6,440,523 | B1 | 8/2002 | Sealey, II et al. |
| 6,440,547 | B1 | 8/2002 | Luo et al. |
| 6,444,314 | B1 | 9/2002 | Luo et al. |
| 6,471,727 | B2 | 10/2002 | Luo et al. |
| 6,491,788 | B2 | 12/2002 | Sealey, II et al. |
| 6,511,930 | B1 | 1/2003 | Luo et al. |
| 6,514,613 | B2 | 2/2003 | Luo et al. |
| 6,515,049 | B1 | 2/2003 | Doenges et al. |
| 6,518,419 | B1 | 2/2003 | Van Der Lugt et al. |
| 6,524,348 | B1 | 2/2003 | Jewell et al. |
| 6,528,163 | B2 | 3/2003 | Sealey, II et al. |
| 6,540,876 | B1 | 4/2003 | Cimecioglu et al. |
| 6,541,627 | B1 | 4/2003 | Ono et al. |
| 6,562,195 | B2 | 5/2003 | Cimecioglu et al. |
| 6,582,559 | B2 | 6/2003 | Thornton et al. |
| 6,586,588 | B1 | 7/2003 | Cimecioglu et al. |
| 6,596,033 | B1 | 7/2003 | Luo et al. |
| 6,605,181 | B1 | 8/2003 | Bergqvist et al. |
| 6,605,350 | B1 | 8/2003 | Sealey, II et al. |
| 6,627,749 | B1 | 9/2003 | Kumar |
| 6,635,755 | B1 | 10/2003 | Jaschinski et al. |
| 6,685,856 | B2 | 2/2004 | Sealey, II et al. |
| 6,686,039 | B2 | 2/2004 | Sealey, II et al. |
| 6,686,040 | B2 | 2/2004 | Sealey, II et al. |
| 6,686,464 | B1 | 2/2004 | Harding et al. |
| 6,692,827 | B2 | 2/2004 | Luo et al. |
| 6,695,950 | B1 | 2/2004 | Cimecioglu et al. |
| 6,706,237 | B2 | 3/2004 | Luo et al. |
| 6,706,876 | B2 | 3/2004 | Luo et al. |
| 6,716,976 | B1 | 4/2004 | Jetten et al. |
| 6,765,042 | B1 | 7/2004 | Thornton et al. |
| 6,770,755 | B1 | 8/2004 | Gunnars et al. |
| 6,773,648 | B2 | 8/2004 | Luo et al. |
| 6,797,113 | B2 | 9/2004 | Sealey, II et al. |
| 6,821,383 | B2 | 11/2004 | Shore et al. |
| 6,824,645 | B2 | 11/2004 | Jaschinski et al. |
| 6,849,156 | B2 | 2/2005 | Besemer et al. |
| 6,861,023 | B2 | 3/2005 | Sealey, II et al. |
| 6,872,821 | B2 | 3/2005 | Cimecioglu et al. |
| 6,896,725 | B2 | 5/2005 | Thornton et al. |
| 6,916,466 | B2 | 7/2005 | Besemer et al. |
| 6,924,369 | B2 | 8/2005 | Doenges et al. |
| 6,936,710 | B2 | 8/2005 | Bragt et al. |
| 6,958,108 | B1 | 10/2005 | Vuorinen |
| 6,987,181 | B2 | 1/2006 | Jaschinski et al. |
| 7,001,483 | B2 | 2/2006 | Severeid et al. |
| 7,019,191 | B2 | 3/2006 | Looney et al. |
| 7,022,837 | B2 | 4/2006 | Harding et al. |
| 7,067,444 | B2 | 6/2006 | Luo et al. |
| 7,083,704 | B2 | 8/2006 | Sealey, II et al. |
| 7,090,744 | B2 | 8/2006 | Sealey, II et al. |
| 7,161,005 | B2 | 1/2007 | Schlingloff et al. |
| 7,247,722 | B2 | 7/2007 | Cimecioglu et al. |
| 7,252,837 | B2 | 8/2007 | Guo et al. |
| 7,279,177 | B2 | 10/2007 | Looney et al. |
| 7,326,317 | B2 | 2/2008 | Westermark et al. |
| 7,390,566 | B2 | 6/2008 | Luo et al. |
| 7,411,110 | B2 | 8/2008 | Sawyer et al. |
| 7,455,902 | B2 | 11/2008 | Weerawarna et al. |
| 7,456,285 | B2 | 11/2008 | Schlingloff et al. |
| 7,520,958 | B2 | 4/2009 | Tan et al. |
| 7,541,396 | B2 | 6/2009 | Luo et al. |
| 7,608,167 | B2 | 10/2009 | Luo et al. |
| 7,692,004 | B2 | 4/2010 | Schlingloff et al. |
| 7,700,764 | B2 | 4/2010 | Heijnesson-Hulten |
| 7,708,214 | B2 | 5/2010 | Medoff |
| 7,727,945 | B2 | 6/2010 | Rodrigues et al. |
| 7,867,358 | B2 | 1/2011 | Medoff |
| 7,867,359 | B2 | 1/2011 | Medoff |
| 7,939,101 | B2 | 5/2011 | Obae et al. |
| 7,947,292 | B2 | 5/2011 | Besemer et al. |
| 7,955,536 | B2 | 6/2011 | Sawyer et al. |
| 7,971,809 | B2 | 7/2011 | Medoff |
| 7,976,676 | B2 | 7/2011 | Yin et al. |
| 8,007,635 | B2 | 8/2011 | Tan et al. |
| 8,029,896 | B2 | 10/2011 | Kumamoto et al. |
| 8,044,013 | B2 | 10/2011 | Schlingloff et al. |
| 8,057,636 | B2 | 11/2011 | Vinson et al. |
| 8,084,391 | B2 | 12/2011 | Weerawarna |
| 8,372,765 | B2 | 2/2013 | Braig et al. |
| 2001/0025695 | A1 | 10/2001 | Patt et al. |
| 2001/0050153 | A1 | 12/2001 | Wajer et al. |
| 2005/0061455 | A1 | 3/2005 | Tan et al. |
| 2006/0070711 | A1 | 4/2006 | Luo |
| 2006/0159733 | A1 | 7/2006 | Pendharkar et al. |
| 2006/0260773 | A1 | 11/2006 | Tan et al. |
| 2007/0000627 | A1 | 1/2007 | Tan et al. |
| 2007/0119556 | A1 | 5/2007 | Tan et al. |
| 2007/0125507 | A1 | 6/2007 | Walter et al. |
| 2007/0199668 | A1 | 8/2007 | Scarpello et al. |
| 2007/0272377 | A1 | 11/2007 | Mei et al. |
| 2007/0277947 | A1 | 12/2007 | Nguyen |
| 2008/0188636 | A1 | 8/2008 | Argyropoulos et al. |
| 2008/0308239 | A1 | 12/2008 | Hart et al. |
| 2009/0044345 | A1 | 2/2009 | Schlingloff et al. |
| 2009/0054863 | A1 | 2/2009 | Tan et al. |
| 2009/0165968 | A1 | 7/2009 | Tan et al. |
| 2009/0312537 | A1 | 12/2009 | Medoff |
| 2010/0055437 | A1 | 3/2010 | Fink et al. |
| 2010/0124583 | A1 | 5/2010 | Medoff |
| 2010/0206501 | A1 | 8/2010 | Medoff |
| 2010/0233481 | A1 | 9/2010 | Isogai et al. |
| 2010/0282422 | A1 | 11/2010 | Miyawaki et al. |
| 2010/0316863 | A1 | 12/2010 | Kumamoto et al. |
| 2010/0320156 | A1 | 12/2010 | Olaiya et al. |
| 2011/0139383 | A1 | 6/2011 | Medoff |
| 2011/0287275 | A1 | 11/2011 | Tan et al. |
| 2012/0004194 | A1 | 1/2012 | Lu et al. |

FOREIGN PATENT DOCUMENTS

| | | |
|---|---|---|
| EP | 0172135 | 2/1986 |
| EP | 0647158 | 8/1997 |
| EP | 0845966 | 3/2000 |
| EP | 0999222 | 5/2000 |
| EP | 1077285 | 2/2001 |
| EP | 1106732 | 6/2001 |

(56) References Cited

FOREIGN PATENT DOCUMENTS

| | | |
|---|---|---|
| EP | 1154074 | 11/2001 |
| EP | 1156065 | 11/2001 |
| EP | 1093467 | 3/2002 |
| EP | 0889997 | 7/2002 |
| EP | 0923635 | 2/2003 |
| EP | 1300420 | 4/2003 |
| EP | 0787231 | 5/2003 |
| EP | 1228099 | 9/2003 |
| EP | 1025305 | 11/2003 |
| EP | 1068376 | 11/2003 |
| EP | 0511695 | 6/2004 |
| EP | 1155039 | 7/2004 |
| EP | 0863158 | 11/2004 |
| EP | 1077286 | 2/2005 |
| EP | 1278913 | 11/2005 |
| EP | 1155040 | 4/2006 |
| EP | 1245722 | 6/2006 |
| EP | 1230456 | 7/2006 |
| EP | 1137672 | 12/2006 |
| WO | WO 1992/014760 | 9/1992 |
| WO | WO 1994/020673 | 9/1994 |
| WO | WO 1994/021690 | 9/1994 |
| WO | WO 1995/006157 | 3/1995 |
| WO | WO 1995/026438 | 10/1995 |
| WO | WO 1995/034628 | 12/1995 |
| WO | WO 1995/035406 | 12/1995 |
| WO | WO 1996/009434 | 3/1996 |
| WO | WO 1996/020667 | 7/1996 |
| WO | WO 1996/038111 | 12/1996 |
| WO | WO 1998/003626 | 1/1998 |
| WO | WO 1998/056981 | 12/1998 |
| WO | WO 1999/009244 | 2/1999 |
| WO | WO 1999/047733 | 9/1999 |
| WO | WO 1999/047744 | 9/1999 |
| WO | WO 1999/057158 | 11/1999 |
| WO | WO 1999/057370 | 11/1999 |
| WO | WO 2000/026257 | 5/2000 |
| WO | WO 2000/050462 | 8/2000 |
| WO | WO 2000/050463 | 8/2000 |
| WO | WO 2000/065145 | 11/2000 |
| WO | WO 2001/029309 | 4/2001 |
| WO | WO 2001/034656 | 5/2001 |
| WO | WO 2001/034657 | 5/2001 |
| WO | WO 2001/083887 | 11/2001 |
| WO | WO 2001/088236 | 11/2001 |
| WO | WO 2002/048196 | 6/2002 |
| WO | WO 2002/048197 | 6/2002 |
| WO | WO 2002/049565 | 6/2002 |
| WO | WO 2002/086206 | 10/2002 |
| WO | WO 2002/088289 | 11/2002 |
| WO | WO 2003/006739 | 1/2003 |
| WO | WO 2003/042451 | 5/2003 |
| WO | WO 2004/062703 | 7/2004 |
| WO | WO 2005/028744 | 3/2005 |
| WO | WO 2005/058972 | 6/2005 |
| WO | WO 2005/068074 | 7/2005 |
| WO | WO 2006/102543 | 9/2006 |
| WO | WO 2006/119392 | 11/2006 |
| WO | WO 2006/125517 | 11/2006 |
| WO | WO 2007/042192 | 4/2007 |
| WO | WO 2007/090461 | 8/2007 |
| WO | WO 2008/010187 | 1/2008 |
| WO | WO 2008/098037 | 8/2008 |
| WO | WO 2008/153565 | 12/2008 |
| WO | WO 2008/154073 | 12/2008 |
| WO | WO 2009/134746 | 11/2009 |
| WO | WO 2010/025224 | 3/2010 |
| WO | WO 2011/002956 | 1/2011 |
| WO | WO 2011/088889 | 7/2011 |
| WO | WO 2011/089123 | 7/2011 |
| WO | WO 2011/090425 | 7/2011 |
| WO | WO 2010/138941 | 12/2012 |
| WO | WO 2012/170183 | 12/2012 |

OTHER PUBLICATIONS

TAPPI, T-525 om-92, 1992, TAPPI.

Zheng Dang et al., "Alkaline peroxide treatment of ECF bleached softwood kraft pulps. Part 1. Characterizing the effect of alkaline peroxide treatment on carboxyl groups of fibers," Holzforschung,vol. 61, pp. 445-450, 2007.

Zheng Dang, "The Investigation of Carboxyl Groups of Pulp Fibers During Kraft Pulping, Alkaline Peroxide Bleaching, and TEMPO-mediated Oxication,"Georgia Institute of Technology, Aug. 2007.

LOW VISCOSITY KRAFT FIBER HAVING REDUCED YELLOWING PROPERTIES AND METHODS OF MAKING AND USING THE SAME

CROSS-REFERENCE TO PRIOR APPLICATIONS

This is a divisional of U.S. application Ser. No. 14/365,903, filed Jun. 16, 2014, which is a national phase of International Application No. PCT/US2013/021224, filed Jan. 11, 2013, which claims the benefit of U.S. provisional Application No. 61/585,833, filed Jan. 12, 2012, each of which is incorporated herein by reference.

This disclosure relates to modified kraft fiber having improved anti-yellowing characteristic. More particularly, this disclosure relates to softwood fiber, e.g., southern pine fiber, that exhibits a unique set of characteristics, improving its performance over other fiber derived from kraft pulp and making it useful in applications that have heretofore been limited to expensive fibers (e.g., cotton or high alpha content sulfite pulp).

This disclosure further relates to chemically modified cellulose fiber derived from bleached softwood that has an ultra low degree of polymerization, making it suitable for use as a chemical cellulose feedstock in the production of cellulose derivatives including cellulose ethers, esters, and viscose, as fluff pulp in absorbent products, and in other consumer product applications. As used herein "degree of polymerization" may be abbreviated "DP." "Ultra low degree of polymerization" may be abbreviated "ULDP."

This disclosure also relates to methods for producing the improved fiber described. The fiber, described, is subjected to digestion and oxygen delignification, followed by bleaching. The fiber is also subject to a catalytic oxidation treatment. In some embodiments, the fiber is oxidized with a combination of hydrogen peroxide and iron or copper and then further bleached to provide a fiber with appropriate brightness characteristics, for example brightness comparable to standard bleached fiber. Further, at least one process is disclosed that can provide the improved beneficial characteristics mentioned above, without the introduction of costly added steps for post-treatment of the bleached fiber. In this less costly embodiment, the fiber can be oxidized in a single stage of a kraft process, such as a kraft bleaching process. Still a further embodiment relates to process including five-stage bleaching comprising a sequence of $D_0$E1D1E2D2, where stage four (E2) comprises the catalytic oxidation treatment.

Finally, this disclosure relates to products produced using the improved modified kraft fiber as described.

Cellulose fiber and derivatives are widely used in paper, absorbent products, food or food-related applications, pharmaceuticals, and in industrial applications. The main sources of cellulose fiber are wood pulp and cotton. The cellulose source and the cellulose processing conditions generally dictate the cellulose fiber characteristics, and therefore, the fiber's applicability for certain end uses. A need exists for cellulose fiber that is relatively inexpensive to process, yet is highly versatile, enabling its use in a variety of applications.

Kraft fiber, produced by a chemical kraft pulping method, provides an inexpensive source of cellulose fiber that generally provides final products with good brightness and strength characteristics. As such, it is widely used in paper applications. However, standard kraft fiber has limited applicability in downstream applications, such as cellulose derivative production, due to the chemical structure of the cellulose resulting from standard kraft pulping and bleaching. In general, standard kraft fiber contains too much residual hemi-cellulose and other naturally occurring materials that may interfere with the subsequent physical and/or chemical modification of the fiber. Moreover, standard kraft fiber has limited chemical functionality, and is generally rigid and not highly compressible.

In the standard kraft process a chemical reagent referred to as "white liquor" is combined with wood chips in a digester to carry out delignification. Delignification refers to the process whereby lignin bound to the cellulose fiber is removed due to its high solubility in hot alkaline solution. This process is often referred to as "cooking." Typically, the white liquor is an alkaline aqueous solution of sodium hydroxide (NaOH) and sodium sulfide ($Na_2S$). Depending upon the wood species used and the desired end product, white liquor is added to the wood chips in sufficient quantity to provide a desired total alkali charge based on the dried weight of the wood.

Generally, the temperature of the wood/liquor mixture in the digester is maintained at about 145° C. to 170° C. for a total reaction time of about 1-3 hours. When digestion is complete, the resulting kraft wood pulp is separated from the spent liquor (black liquor) which includes the used chemicals and dissolved lignin. Conventionally, the black liquor is burnt in a kraft recovery process to recover the sodium and sulphur chemicals for reuse.

At this stage, the kraft pulp exhibits a characteristic brownish color due to lignin residues that remain on the cellulose fiber. Following digestion and washing, the fiber is often bleached to remove additional lignin and whiten and brighten the fiber. Because bleaching chemicals are much more expensive than cooking chemicals, typically, as much lignin as possible is removed during the cooking process. However, it is understood that these processes need to be balanced because removing too much lignin can increase cellulose degradation. The typical Kappa number (the measure used to determine the amount of residual lignin in pulp) of softwood after cooking and prior to bleaching is in the range of 28 to 32.

Following digestion and washing, the fiber is generally bleached in multi-stage sequences, which traditionally comprise strongly acidic and strongly alkaline bleaching steps, including at least one alkaline step at or near the end of the bleaching sequence. Bleaching of wood pulp is generally conducted with the aim of selectively increasing the whiteness or brightness of the pulp, typically by removing lignin and other impurities, without negatively affecting physical properties. Bleaching of chemical pulps, such as kraft pulps, generally requires several different bleaching stages to achieve a desired brightness with good selectivity. Typically, a bleaching sequence employs stages conducted at alternating pH ranges. This alternation aids in the removal of impurities generated in the bleaching sequence, for example, by solubilizing the products of lignin breakdown. Thus, in general, it is expected that using a series of acidic stages in a bleaching sequence, such as three acidic stages in sequence, would not provide the same brightness as alternating acidic/alkaline stages, such as acidic-alkaline-acidic. For instance, a typical DEDED sequence produces a brighter product than a DEDAD sequence (where A refers to an acid treatment).

Cellulose exists generally as a polymer chain comprising hundreds to tens of thousands of glucose units. Cellulose may be oxidized to modify its functionality. Various methods of oxidizing cellulose are known. In cellulose oxidation, hydroxyl groups of the glycosides of the cellulose chains can be converted, for example, to carbonyl groups such as aldehyde groups or carboxylic acid groups. Depending on the oxidation method and conditions used, the type, degree, and location of the carbonyl modifications may vary. It is known that certain oxidation conditions may degrade the cellulose chains themselves, for example by cleaving the glycosidic rings in the cellulose chain, resulting in depolymerization. In most instances, depolymerized cellulose not only has a reduced viscosity, but also has a shorter fiber length than the starting cellulosic material. When cellulose is degraded, such as by depolymerizing and/or significantly reducing the fiber length and/or the fiber strength, it may be difficult to process and/or may be unsuitable for many downstream applications. A need remains for methods of modifying cellulose fiber that may improve both carboxylic acid and aldehyde functionalities, which methods do not extensively degrade the cellulose fiber.

Various attempts have been made to oxidize cellulose to provide both carboxylic and aldehydic functionality to the cellulose chain without degrading the cellulose fiber. In many cellulose oxidation methods, it has been difficult to control or limit the degradation of the cellulose when aldehyde groups are present on the cellulose. Previous attempts at resolving these issues have included the use of multi-step oxidation processes, for instance site-specifically modifying certain carbonyl groups in one step and oxidizing other hydroxyl groups in another step, and/or providing mediating agents and/or protecting agents, all of which may impart extra cost and by-products to a cellulose oxidation process. Thus, there exists a need for methods of modifying cellulose that are cost effective and/or can be performed in a single step of a process, such as a kraft process.

In addition to the difficulties in controlling the chemical structure of cellulose oxidation products, and the degradation of those products, it is known that the method of oxidation may affect other properties, including chemical and physical properties and/or impurities in the final products. For instance, the method of oxidation may affect the degree of crystallinity, the hemi-cellulose content, the color, and/or the levels of impurities in the final product and the yellowing characteristics of the fiber. Ultimately, the method of oxidation may impact the ability to process the cellulose product for industrial or other applications.

Traditionally, cellulose sources that were useful in the production of absorbent products or tissue were not also useful in the production of downstream cellulose derivatives, such as cellulose ethers and cellulose esters. The production of low viscosity cellulose derivatives from high viscosity cellulose raw materials, such as standard kraft fiber, requires additional manufacturing steps that would add significant cost while imparting unwanted by-products and reducing the overall quality of the cellulose derivative. Cotton linter and high alpha cellulose content sulfite pulps are typically used in the manufacture of cellulose derivatives such as cellulose ethers and esters. However, production of cotton linters and sulfite fiber with a high degree of polymerization (DP) and/or viscosity is expensive due to 1) the cost of the starting material, in the case of cotton; 2) the high energy, chemical, and environmental costs of pulping and bleaching, in the case of sulfite pulps; and 3) the extensive purifying processes required, which applies in both cases. In addition to the high cost, there is a dwindling supply of sulfite pulps available to the market. Therefore, these fibers are very expensive, and have limited applicability in pulp and paper applications, for example, where higher purity or higher viscosity pulps may be required. For cellulose derivative manufacturers these pulps constitute a significant portion of their overall manufacturing cost. Thus, there exists a need for high purity, white, bright, stable against yellowing, low cost fibers, such as a kraft fiber, that may be used in the production of cellulose derivatives.

There is also a need for inexpensive cellulose materials that can be used in the manufacture of microcrystalline cellulose. Microcrystalline cellulose is widely used in food, pharmaceutical, cosmetic, and industrial applications, and is a purified crystalline form of partially depolymerized cellulose. The use of kraft fiber in microcrystalline cellulose production, without the addition of extensive post-bleaching processing steps, has heretofore been limited. Microcrystalline cellulose production generally requires a highly purified cellulosic starting material, which is acid hydrolyzed to remove amorphous segments of the cellulose chain. See U.S. Pat. No. 2,978,446 to Battista et al. and U.S. Pat. No. 5,346,589 to Braunstein et al. A low degree of polymerization of the chains upon removal of the amorphous segments of cellulose, termed the "level-off DP," is frequently a starting point for microcrystalline cellulose production and its numerical value depends primarily on the source and the processing of the cellulose fibers. The dissolution of the non-crystalline segments from standard kraft fiber generally degrades the fiber to an extent that renders it unsuitable for most applications because of at least one of 1) remaining impurities; 2) a lack of sufficiently long crystalline segments; or 3) it results in a cellulose fiber having too high a degree of polymerization, typically in the range of 200 to 400, to make it useful in the production of microcrystalline cellulose. Kraft fiber having an increased alpha cellulose content, for example, would be desirable, as the kraft fiber may provide greater versatility in microcrystalline cellulose production and applications.

In the present disclosure, fiber having an ultra low DP can be produced with limited chemical modification resulting in a pulp having improved properties, including but not limited to, brightness and a reduced tendency to yellow. Fiber of the present disclosure overcomes certain limitations associated with known kraft fiber discussed herein.

The methods of the present disclosure result in products that have characteristics that are not seen in prior art fibers. Thus, the methods of the disclosure can be used to produce products that are superior to products of the prior art. In addition, the fiber of the present invention can be cost-effectively produced.

DESCRIPTION

I. Methods

Figure 1:
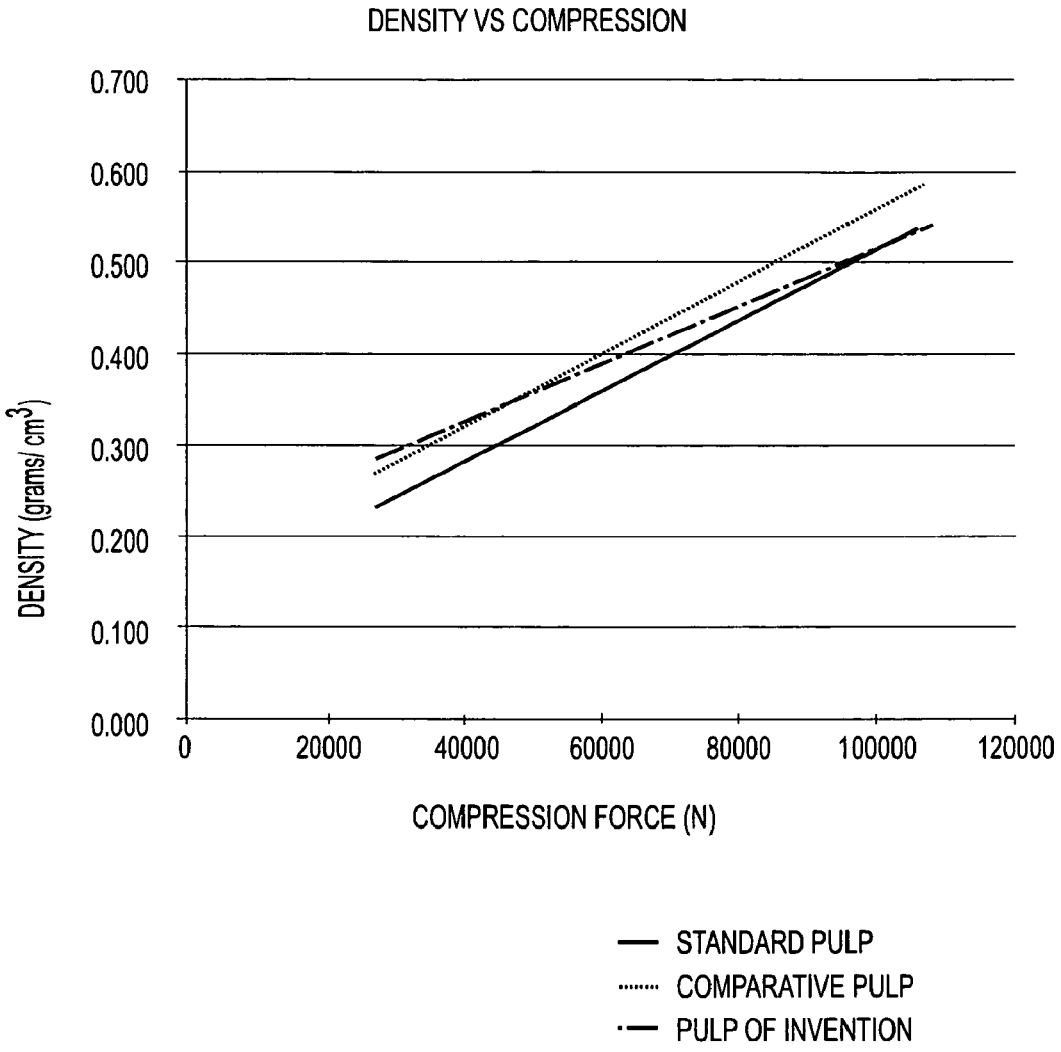
FIG. 1 is a graph of pulp fiber density as a function of compression.

The present disclosure provides novel methods for producing cellulose fiber. The method comprises subjecting cellulose to a kraft pulping step, an oxygen delignification step, and a bleaching sequence which includes at least one catalytic oxidation stage followed by at least one bleaching stage. In one embodiment, the conditions under which the cellulose is processed result in softwood fiber exhibiting high brightness and low viscosity (ultra low DP) while reducing the tendency of the fiber to yellow upon exposure to heat, light and/or chemical treatment.

The cellulose fiber used in the methods described herein may be derived from softwood fiber, hardwood fiber, and mixtures thereof. In some embodiments, the modified cellulose fiber is derived from softwood, such as southern pine. In some embodiments, the modified cellulose fiber is derived from hardwood, such as eucalyptus. In some embodiments, the modified cellulose fiber is derived from a mixture of softwood and hardwood. In yet another embodiment, the modified cellulose fiber is derived from cellulose fiber that has previously been subjected to all or part of a kraft process, i.e., kraft fiber.

References in this disclosure to "cellulose fiber," "kraft fiber," "pulp fiber" or "pulp" are interchangeable except where specifically indicated to be different or where one of ordinary skill in the art would understand them to be different. As used herein "modified kraft fiber," i.e., fiber which has been cooked, bleached and oxidized in accordance with the present disclosure may be used interchangeably with "kraft fiber" or "pulp fiber" to the extent that the context warrants it.

The present disclosure provides novel methods for treating cellulose fiber. In some embodiments, the disclosure provides a method of modifying cellulose fiber, comprising providing cellulose fiber, and oxidizing the cellulose fiber. As used herein, "oxidized," "catalytically oxidized," "catalytic oxidation" and "oxidation" are all understood to be interchangeable and refer to treatment of cellulose fiber with at least one metal catalyst, such as iron or copper and at least one peroxide, such as hydrogen peroxide, such that at least some of the hydroxyl groups of the cellulose fibers are oxidized. The phrase "iron or copper" and similarly "iron (or copper)" mean "iron or copper or a combination thereof." In some embodiments, the oxidation comprises simultaneously increasing carboxylic acid and aldehyde content of the cellulose fiber.

In one method of the invention, cellulose, preferably southern pine, is digested in a two-vessel hydraulic digester with, Lo-Solids® cooking to a kappa number ranging from about 17 to about 21. The resulting pulp is subjected to oxygen delignification until it reaches a kappa number of about 8 or below. The cellulose pulp is then bleached in a multi-stage bleaching sequence which includes at least one catalytic oxidation stage prior to the final bleach stage.

In one embodiment, the method comprises digesting the cellulose fiber in a continuous digester with a co-current, down-flow arrangement. The effective alkali ("EA") of the white liquor charge is at least about 15% on pulp, for example, at least about 15.5% on pulp, for example at least about 16% on pulp, for example, at least about 16.4% on pulp, for example at least about 17% on pulp. As used herein a "% on pulp" refers to an amount based on the dry weight of the kraft pulp. In one embodiment, the white liquor charge is divided with a portion of the white liquor being applied to the cellulose in the impregnator and the remainder of the white liquor being applied to the pulp in the digester. According to one embodiment, the white liquor is applied in a 50:50 ratio. In another embodiment, the white liquor is applied in a range of from 90:10 to 30:70, for example in a range from 50:50 to 70:30, for example 60:40. According to one embodiment, the white liquor is added to the digester in a series of stages. According to one embodiment, digestion is carried out at a temperature between about 160° C. to about 168° C., for example, from about 163° C. to about 168° C., for example, from about 166° C. to about 168° C., and the cellulose is treated until a target kappa number between about 17 and about 21 is reached. It is believed that the higher than normal effective alkali ("EA") and higher temperatures than used in the prior art achieve the lower than normal Kappa number.

According to one embodiment of the invention, the digester is run with an increase in push flow which increases the liquid to wood ratio as the cellulose enters the digester. This addition of white liquor is believed to assist in maintaining the digester at a hydraulic equilibrium and assists in achieving a continuous down-flow condition in the digester.

In one embodiment, the method comprises oxygen delignifying the cellulose fiber after it has been cooked to a kappa number from about 17 to about 21 to further reduce the lignin content and further reduce the kappa number, prior to bleaching. Oxygen delignification can be performed by any method known to those of ordinary skill in the art. For instance, oxygen delignification may be carried out in a conventional two-stage oxygen delignification process. Advantageously, the delignification is carried out to a target kappa number of about 8 or lower, more particularly about 6 to about 8.

In one embodiment, during oxygen delignification, the applied oxygen is less than about 3% on pulp, for example, less than about 2.4% on pulp, for example, less than about 2% on pulp. According to one embodiment, fresh caustic is added to the cellulose during oxygen delignification. Fresh caustic may be added in an amount of from about 2.5% on pulp to about 3.8% on pulp, for example, from about 3% on pulp to about 3.2% on pulp. According to one embodiment, the ratio of oxygen to caustic is reduced over standard kraft production; however the absolute amount of oxygen remains the same. Delignification may be carried out at a temperature of from about 93° C. to about 104° C., for example, from about 96° C. to about 102° C., for example, from about 98° C. to about 99° C.

After the fiber has reaches a Kappa Number of about 8 or less, the fiber is subjected to a multistage bleaching sequence. The stages of the multi-stage bleaching sequence may include any conventional or after discovered series of stages and may be conducted under conventional conditions In some embodiments, prior to bleaching the pH of the cellulose is adjusted to a pH ranging from about 2 to about 6, for example from about 2 to about 5 or from about 2 to about 4, or from about 2 to about 3.

The pH can be adjusted using any suitable acid, as a person of skill would recognize, for example, sulfuric acid or hydrochloric acid or filtrate from an acidic bleach stage of a bleaching process, such as a chlorine dioxide (D) stage of a multi-stage bleaching process. For example, the cellulose fiber may be acidified by adding an extraneous acid. Examples of extraneous acids are known in the art and include, but are not limited to, sulfuric acid, hydrochloric acid, and carbonic acid. In some embodiments, the cellulose fiber is acidified with acidic filtrate, such as waste filtrate, from a bleaching step. In at least one embodiment, the cellulose fiber is acidified with acidic filtrate from a D stage of a multi-stage bleaching process. The fiber, described, is subjected to a catalytic oxidation treatment. In some embodiments, the fiber is oxidized with iron or copper and then further bleached to provide a fiber with beneficial brightness characteristics.

As discussed above, in accordance with the disclosure, oxidation of cellulose fiber involves treating the cellulose fiber with at least a catalytic amount of a metal catalyst, such as iron or copper and a peroxygen, such as hydrogen peroxide. In at least one embodiment, the method comprises oxidizing cellulose fiber with iron and hydrogen peroxide. The source of iron can be any suitable source, as a person of skill would recognize, such as for example ferrous sulfate (for example ferrous sulfate heptahydrate), ferrous chloride, ferrous ammonium sulfate, ferric chloride, ferric ammonium sulfate, or ferric ammonium citrate.

In some embodiments, the method comprises oxidizing the cellulose fiber with copper and hydrogen peroxide. Similarly, the source of copper can be any suitable source as a person of skill would recognize. Finally, in some embodiments, the method comprises oxidizing the cellulose fiber with a combination of copper and iron and hydrogen peroxide.

When cellulose fiber is oxidized in a bleaching step, cellulose fiber should not be subjected to substantially alkaline conditions in the bleaching process during or after the oxidation. In some embodiments, the method comprises oxidizing cellulose fiber at an acidic pH. In some embodiments, the method comprises providing cellulose fiber, acidifying the cellulose fiber, and then oxidizing the cellulose fiber at acidic pH. In some embodiments, the pH ranges from about 2 to about 6, for example from about 2 to about 5 or from about 2 to about 4.

In some embodiments, the method comprises oxidizing the cellulose fiber in one or more stages of a multi-stage bleaching sequence. In some embodiments, the method comprises oxidizing the cellulose fiber in a single stage of a multi-stage bleaching sequence. In some embodiments, the method comprises oxidizing the cellulose fiber at or near the end of a multi-stage bleaching sequence. In some embodiments, the method comprises at least one bleaching step following the oxidation step. In some embodiments, the method comprises oxidizing cellulose fiber in the fourth stage of a five-stage bleaching sequence.

In accordance with the disclosure, the multi-stage bleaching sequence can be any bleaching sequence that does not comprise an alkaline bleaching step following the oxidation step. In at least one embodiment, the multi-stage bleaching sequence is a five-stage bleaching sequence. In some embodiments, the bleaching sequence is a DEDED sequence. In some embodiments, the bleaching sequence is a $D_0$E1D1E2D2 sequence. In some embodiments, the bleaching sequence is a $D_0$(EoP)D1E2D2 sequence. In some embodiments the bleaching sequence is a $D_0$(EO)D1E2D2.

The non-oxidation stages of a multi-stage bleaching sequence may include any convention or after discovered series of stages, be conducted under conventional conditions, with the proviso that to be useful in producing the modified fiber described in the present disclosure, no alkaline bleaching step may follow the oxidation step.

In some embodiments, the oxidation is incorporated into the fourth stage of a multi-stage bleaching process. In some embodiments, the method is implemented in a five-stage bleaching process having a sequence of $D_0$E1D1E2D2, and the fourth stage (E2) is used for oxidizing kraft fiber.

In some embodiments, the kappa number increases after oxidation of the cellulose fiber. More specifically, one would typically expect a decrease in kappa number across this bleaching stage based upon the anticipated decrease in material, such as lignin, which reacts with the permanganate reagent. However, in the method as described herein, the kappa number of cellulose fiber may decrease because of the loss of impurities, e.g., lignin; however, the kappa number may increase because of the chemical modification of the fiber. Not wishing to be bound by theory, it is believed that the increased functionality of the modified cellulose provides additional sites that can react with the permanganate reagent. Accordingly, the kappa number of modified kraft fiber is elevated relative to the kappa number of standard kraft fiber.

In at least one embodiment, the oxidation occurs in a single stage of a bleaching sequence after both the iron or copper and peroxide have been added and some retention time provided. An appropriate retention is an amount of time that is sufficient to catalyze the hydrogen peroxide with the iron or copper. Such time will be easily ascertainable by a person of ordinary skill in the art.

In accordance with the disclosure, the oxidation is carried out for a time and at a temperature that is sufficient to produce the desired completion of the reaction. For example, the oxidation may be carried out at a temperature ranging from about 60 to about 80° C., and for a time ranging from about 40 to about 80 minutes. The desired time and temperature of the oxidation reaction will be readily ascertainable by a person of skill in the art.

According to one embodiment, the cellulose is subjected to a D(EoP)DE2D bleaching sequence. According to this embodiment, the first D stage ($D_0$) of the bleaching sequence is carried out at a temperature of at least about 57° C., for example at least about 60° C., for example, at least about 66° C., for example, at least about 71° C. and at a pH of less than about 3, for example about 2.5. Chlorine dioxide is applied in an amount of greater than about 0.6% on pulp, for example, greater than about 0.8% on pulp, for example about 0.9% on pulp. Acid is applied to the cellulose in an amount sufficient to maintain the pH, for example, in an amount of at least about 1% on pulp, for example, at least about 1.15% on pulp, for example, at least about 1.25% on pulp.

According to one embodiment, the first E stage ($E_1$), is carried out at a temperature of at least about 74° C., for example at least about 77° C., for example at least about 79° C., for example at least about 82° C., and at a pH of greater than about 11, for example, greater than 11.2, for example about 11.4. Caustic is applied in an amount of greater than about 0.7% on pulp, for example, greater than about 0.8% on pulp, for example about 1.0% on pulp. Oxygen is applied to the cellulose in an amount of at least about 0.48% on pulp, for example, at least about 0.5% on pulp, for example, at least about 0.53% on pulp. Hydrogen Peroxide is applied to the cellulose in an amount of at least about 0.35% on pulp, for example at least about 0.37% on pulp, for example, at least about 0.38% on pulp, for example, at least about 0.4% on pulp, for example, at least about 0.45% on pulp. The skilled artisan would recognize that any known peroxygen compound could be used to replace some or all of the hydrogen peroxide.

According to one embodiment of the invention, the kappa number after the D(EoP) stage is about 2.2 or less.

According to one embodiment, the second D stage ($D_1$) of the bleaching sequence is carried out at a temperature of at least about 74° C., for example at least about 77° C., for example, at least about 79° C., for example, at least about 82° C. and at a pH of less than about 4, for example less than 3.5, for example less than 3.2. Chlorine dioxide is applied in an amount of less than about 1% on pulp, for example, less than about 0.8% on pulp, for example about 0.7% on pulp. Caustic is applied to the cellulose in an amount effective to adjust to the desired pH, for example, in an amount of less than about 0.015% on pulp, for example, less than about 0.01% pulp, for example, about 0.0075% on pulp. The TAPPI viscosity of the pulp after this bleaching stage may be 9-12 mPa·s, for example.

According to one embodiment, the second E stage ($E_2$), is carried out at a temperature of at least about 74° C., for example at least about 79° C. and at a pH of greater than about 2.5, for example, greater than 2.9, for example about 3.3. An iron catalyst is added in, for example, aqueous solution at a rate of from about 25 to about 100 ppm $Fe^{+2}$, for example, from 25 to 75 ppm, for example, from 50 to 75 ppm, iron on pulp. Hydrogen Peroxide is applied to the cellulose in an amount of less than about 0.5% on pulp. The skilled artisan would recognize that any known peroxygen compound could be used to replace some or all of the hydrogen peroxide.

In accordance with the disclosure, hydrogen peroxide is added to the cellulose fiber in acidic media in an amount sufficient to achieve the desired oxidation and/or degree of polymerization and/or viscosity of the final cellulose product. For example, peroxide can be added as a solution at a concentration from about 1% to about 50% by weight in an amount of from about 0.1 to about 0.5%, or from about 0.1% to about 0.3%, or from about 0.1% to about 0.2%, or from about 0.2% to about 0.3%, based on the dry weight of the pulp.

Iron or copper are added at least in an amount sufficient to catalyze the oxidation of the cellulose with peroxide. For example, iron can be added in an amount ranging from about 25 to about 100 ppm based on the dry weight of the kraft pulp, for example, from 25 to 75 ppm, for example, from 50 to 75 ppm. A person of skill in the art will be able to readily optimize the amount of iron or copper to achieve the desired level or amount of oxidation and/or degree of polymerization and/or viscosity of the final cellulose product.

In some embodiments, the method further involves adding heat, such as through steam, either before or after the addition of hydrogen peroxide.

In some embodiments, the final DP and/or viscosity of the pulp can be controlled by the amount of iron or copper and hydrogen peroxide and the robustness of the bleaching conditions prior to the oxidation step. A person of skill in the art will recognize that other properties of the modified kraft fiber of the disclosure may be affected by the amounts of catalyst and peroxide and the robustness of the bleaching conditions prior to the oxidation step. For example, a person of skill in the art may adjust the amounts of iron or copper and hydrogen peroxide and the robustness of the bleaching conditions prior to the oxidation step to target or achieve a desired brightness in the final product and/or a desired degree of polymerization or viscosity.

In some embodiments, a kraft pulp is acidified on a D1 stage washer, the iron source (or copper source) is also added to the kraft pulp on the D1 stage washer, the peroxide is added following the iron source (or copper source) at an addition point in the mixer or pump before the E2 stage tower, the kraft pulp is reacted in the E2 tower and washed on the E2 washer, and steam may optionally be added before the E2 tower in a steam mixer.

In some embodiments, iron (or copper) can be added up until the end of the D1 stage, or the iron (or copper) can also be added at the beginning of the E2 stage, provided that the pulp is acidified first (i.e., prior to addition of the iron (or copper)) at the D1 stage. Steam may be optionally added either before or after the addition of the peroxide.

For example, in some embodiments, the treatment with hydrogen peroxide in an acidic media with iron (or copper) may involve adjusting the pH of the kraft pulp to a pH ranging from about 2 to about 5, adding a source of iron (or copper) to the acidified pulp, and adding hydrogen peroxide to the kraft pulp.

According to one embodiment, the third D stage ($D_2$) of the bleaching sequence is carried out at a temperature of at least about 74° C., for example at least about 77° C. for example, at least about 79° C., for example, at least about 82° C. and at a pH of less than about 4, for example less than about 3.8. Chlorine dioxide is applied in an amount of less than about 0.5% on pulp, for example, less than about 0.3% on pulp, for example about 0.15% on pulp.

Alternatively, the multi-stage bleaching sequence may be altered to provide more robust bleaching conditions prior to oxidizing the cellulose fiber. In some embodiments, the method comprises providing more robust bleaching conditions prior to the oxidation step. More robust bleaching conditions may allow the degree of polymerization and/or viscosity of the cellulose fiber to be reduced in the oxidation step with lesser amounts of iron or copper and/or hydrogen peroxide. Thus, it may be possible to modify the bleaching sequence conditions so that the brightness and/or viscosity of the final cellulose product can be further controlled. For instance, reducing the amounts of peroxide and metal, while providing more robust bleaching conditions before oxidation, may provide a product with lower viscosity and higher brightness than an oxidized product produced with identical oxidation conditions but with less robust bleaching. Such conditions may be advantageous in some embodiments, particularly in cellulose ether applications.

In some embodiments, for example, the method of preparing a modified cellulose fiber within the scope of the disclosure may involve acidifying the kraft pulp to a pH ranging from about 2 to about 5 (using for example sulfuric acid), mixing a source of iron (for example ferrous sulfate, for example ferrous sulfate heptahydrate) with the acidified kraft pulp at an application of from about 25 to about 250 ppm $Fe^{+2}$ based on the dry weight of the kraft pulp at a consistency ranging from about 1% to about 15% and also hydrogen peroxide, which can be added as a solution at a concentration of from about 1% to about 50% by weight and in an amount ranging from about 0.1% to about 1.5% based on the dry weight of the kraft pulp. In some embodiments, the ferrous sulfate solution is mixed with the kraft pulp at a consistency ranging from about 7% to about 15%. In some embodiments the acidic kraft pulp is mixed with the iron source and reacted with the hydrogen peroxide for a time period ranging from about 40 to about 80 minutes at a temperature ranging from about 60 to about 80° C.

In some embodiments, each stage of the five-stage bleaching process includes at least a mixer, a reactor, and a washer (as is known to those of skill in the art).

In some embodiments, the disclosure provides a method for controlling odor, comprising providing a modified bleached kraft fiber according to the disclosure, and applying an odorant to the bleached kraft fiber such that the atmospheric amount of odorant is reduced in comparison with the atmospheric amount of odorant upon application of an equivalent amount of odorant to an equivalent weight of standard kraft fiber. In some embodiments the disclosure provides a method for controlling odor comprising inhibiting bacterial odor generation. In some embodiments, the disclosure provides a method for controlling odor comprising absorbing odorants, such as nitrogenous odorants, onto a modified kraft fiber. As used herein, "nitrogenous odorants" is understood to mean odorants comprising at least one nitrogen.

According to one embodiment, the density of kraft fiber as a function of compressive force can be seen in FIG. 1. Figure shows the change in density of a pulp fiber under compressive force. The graph compares the pulp fiber of the invention with a fiber made in accordance with the comparative Example 4, and with a standard fluff pulp. As can be seen from the graph, the pulp fiber of the invention is more compressible than standard fluff pulp.

Figure 2:
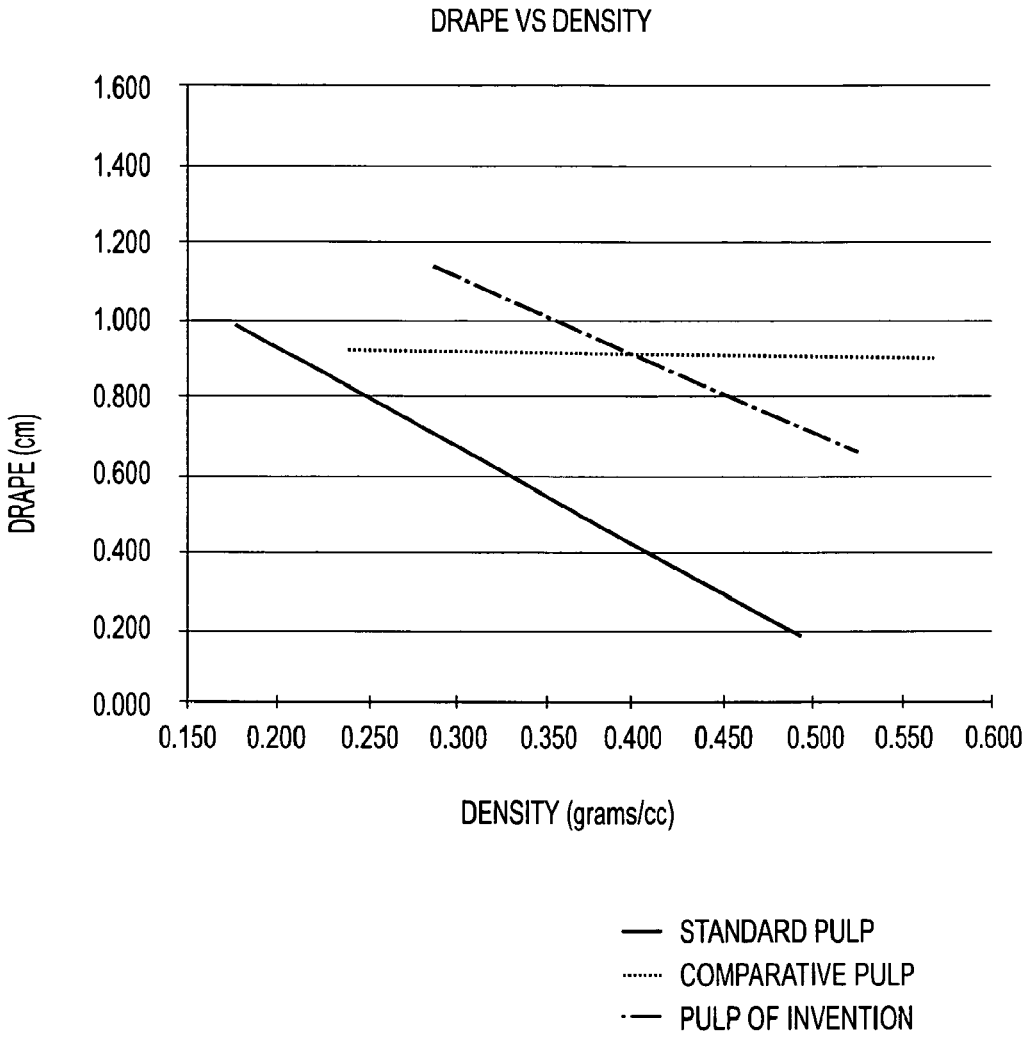
FIG. 2 is a graph of drape as a function of density.

According to one embodiment, the drape of the pulp fiber as a function of density can be seen in FIG. 2. FIG. 2 shows the drape of the pulp fiber as its density is increased. The graph compares the pulp fiber of the invention with a fiber made in accordance with the comparative Example 4, and with a standard fluff pulp. As can be seen from the graph, the pulp fiber of the invention shows a drape that is significantly better than that seen in standard fluff pulp. Further, at low densities, the fiber of the invention has better drape than the pulp fiber of the comparative example.

In at least one embodiment, the method comprises providing cellulose fiber, partially bleaching the cellulose fiber, and oxidizing the cellulose fiber. In some embodiments, the oxidation is conducted in the bleaching process. In some embodiments, the oxidation is conducted after the bleaching process.

In some embodiments, the disclosure provides a method for producing fluff pulp, comprising providing kraft fiber of the disclosure and then producing a fluff pulp. For example, the method comprises bleaching kraft fiber in a multi-stage bleaching process, and then forming a fluff pulp. In at least one embodiment, the fiber is not refined after the multi-stage bleaching process.

In some embodiments, the kraft fiber is combined with at least one super absorbent polymer (SAP). In some embodiments, the SAP may by an odor reductant. Examples of SAP that can be used in accordance with the disclosure include, but are not limited to, Hysorb™ sold by the company BASF, Aqua Keep® sold by the company Sumitomo, and FAVOR®, sold by the company Evonik.

II. Kraft Fibers

Reference is made herein to "standard," "conventional," or "traditional," kraft fiber, kraft bleached fiber, kraft pulp or kraft bleached pulp. Such fiber or pulp is often described as a reference point for defining the improved properties of the present invention. As used herein, these terms are interchangeable and refer to the fiber or pulp which is identical in composition to and processed in a like standard manner. As used herein, a standard kraft process includes both a cooking stage and a bleaching stage under art recognized conditions. Standard kraft processing does not include a pre-hydrolysis stage prior to digestion.

Physical characteristics (for example, purity, brightness, fiber length and viscosity) of the kraft cellulose fiber mentioned in the specification are measured in accordance with protocols provided in the Examples section.

In some embodiments, modified kraft fiber of the disclosure has a brightness equivalent to standard kraft fiber. In some embodiments, the modified cellulose fiber has a brightness of at least 85, 86, 87, 88, 89, or 90 ISO. In some embodiments, the brightness is no more than about 92. In some embodiments, the brightness ranges from about 85 to about 92, or from about 86 to about 91, or from about 87 to about 91, or from about 88 to about 91.

In some embodiments, cellulose according to the present disclosure has an R18 value in the range of from about 84% to about 86%, for instance R18 has a value of at least about 86%.

In some embodiments, kraft fiber according to the disclosure has an R10 value ranging from about 80% to about 83%, for instance from about 80.5% to about 82.5%, for example from about 81.5.2% to about 82.2%. The R18 and R10 content is described in TAPPI T235. R10 represents the residual undissolved material that is left after extraction of the pulp with 10 percent by weight caustic and R18 represents the residual amount of undissolved material left after extraction of the pulp with an 18% caustic solution. Generally, in a 10% caustic solution, hemicellulose and chemically degraded short chain cellulose are dissolved and removed in solution. In contrast, generally only hemicellulose is dissolved and removed in an 18% caustic solution. Thus, the difference between the R10 value and the R18 value, ($\Delta R = R18 - R10$), represents the amount of chemically degraded short chained cellulose that is present in the pulp sample.

In some embodiments, modified cellulose fiber has an S10 caustic solubility ranging from about 17% to about 20%, or from about 17.5% to about 19.5%. In some embodiments, modified cellulose fiber has an S18 caustic solubility ranging from about 14% to about 16%, or from about 14.5% to about 15.5%.

The present disclosure provides kraft fiber with low and ultra-low viscosity. Unless otherwise specified, "viscosity" as used herein refers to 0.5% Capillary CED viscosity measured according to TAPPI T230-om99 as referenced in the protocols.

Unless otherwise specified, "DP" as used herein refers to average degree of polymerization by weight (DPw) calculated from 0.5% Capillary CEO viscosity measured according to TAPPI T230-om99. See, e.g., J. F. Cellucon Conference in *The Chemistry and Processing of Wood and Plant Fibrous Materials*, p. 155, test protocol 8, 1994 (Woodhead Publishing Ltd., Abington Hall, Abinton Cambridge CBI 6AH England, J. F. Kennedy et al. eds.) "Low DP" means a DP ranging from about 1160 to about 1860 or a viscosity ranging from about 7 to about 13 mPa·s. "Ultra low DP" fibers means a DP ranging from about 350 to about 1160 or a viscosity ranging from about 3 to about 7 mPa·s.

In some embodiments, modified cellulose fiber has a viscosity ranging from about 4.0 mPa·s to about 6 mPa·s. In some embodiments, the viscosity ranges from about 4.0 mPa·s to about 5.5 mPa·s. In some embodiments, the viscosity ranges from about 4.5 mPa·s to about 5.5 mPa·s. In some embodiments, the viscosity ranges from about 5.0 mPa·s to about 5.5 mPa·s. In some embodiments, the viscosity is less than 6 mPa·s, less than 5.5 mPa·s, less than 5.0 mPa·s, or less than 4.5 mPa·s.

The modified kraft fiber according to the present disclosure also exhibits an improved anti-yellowing characteristic when compared to other ultra-low viscosity fibers. The modified kraft fibers of the present invention have a b* color value, in the NaOH saturated state, of less than about 30, for example less than about 27, for example less than about 25, for example less than about 22. The test for b* color value in the saturated state is as follows: Samples are cut into 3"×3" squares. Each of the squares is placed separately in a tray and 30 mls of 18% NaOH is added to saturate the sheet. The square is then removed from the tray and NaOH solution after 5 minutes, at which time it is in "the NaOH saturated state," The brightness and color values are measured on the saturated sheet. The brightness and color values as CIE L*, a*, b* coordinates were determined on a Hunterlab MiniScan™ XE instrument. Alternatively, the anti-yellowing characteristic can be represented as the difference between the b* color of the sheet before saturation and after saturation. See Example 5, below. The sheet that changes the least has the best anti-yellowing characteristics. The modified kraft fiber of the invention has a $\Delta b^*$ of less than about 25, for example, less than about 22, for example less than about 20, for example less than about 18.

In some embodiments, kraft fiber of the disclosure is more compressible and/or embossable than standard kraft fiber. In some embodiments, kraft fiber may be used to produce structures that are thinner and/or have higher density than structures produced with equivalent amounts of standard kraft fiber.

In some embodiments, kraft fiber of the disclosure maintains its fiber length during the bleaching process.

"Fiber length" and "average fiber length" are used interchangeably when used to describe the property of a fiber and mean the length-weighted average fiber length. Therefore, for example, a fiber having an average fiber length of 2 mm should be understood to mean a fiber having a length-weighted average fiber length of 2 mm.

In some embodiments, when the kraft fiber is a softwood fiber, the cellulose fiber has an average fiber length, as measured in accordance with Test Protocol 12, described in the Example section below, that is about 2 mm or greater. In some embodiments, the average fiber length is no more than about 3.7 mm. In some embodiments, the average fiber length is at least about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, or about 3.7 mm. In some embodiments, the average fiber length ranges from about 2 mm to about 3.7 mm, or from about 2.2 mm to about 3.7 mm.

In some embodiments, modified kraft fiber of the disclosure has increased carboxyl content relative to standard kraft fiber.

In some embodiments, modified cellulose fiber has a carboxyl content ranging from about 2 meq/100 g to about 4 meq/100 g. In some embodiments, the carboxyl content ranges from about 3 meq/100 g to about 4 meq/100 g. In some embodiments, the carboxyl content is at least about 2 meq/100 g, for example, at least about 2.5 meq/100 g, for example, at least about 3.0 meq/100 g, for example, at least about 3.5 meq/100 g.

In some embodiments, modified cellulose fiber has a carbonyl content ranging from about 1.5 meq/100 g to about 2.5 meq/100 g. In some embodiments, the carbonyl content ranges from about 1.5 meq/100 g to about 2 meq/100 g. In some embodiments, the carbonyl content is less than about 2.5 meq/100 g, for example, less than about 2.0 meq/100 g, for example, less than about 1.5 meq/100 g.

Kraft fiber of the disclosure may be more flexible than standard kraft fiber, and may elongate and/or bend and/or exhibit elasticity and/or increase wicking. Additionally, it is expected that the kraft fiber of the disclosure would be softer than standard kraft fiber, enhancing their applicability in absorbent product applications, for example, such as diaper and bandage applications.

In some embodiments, the modified cellulose fiber has a copper number less than about 2. In some embodiments, the copper number is less than about 1.5. In some embodiments, the copper number is less than about 1.3. In some embodiments, the copper number ranges from about 1.0 to about 2.0, such as from about 1.1 to about 1.5.

In at least one embodiment, the hemicellulose content of the modified kraft fiber is substantially the same as standard unbleached kraft fiber. For example, the hemicellulose content for a softwood kraft fiber may range from about 12% to about 17%. For instance, the hemicellulose content of a hardwood kraft fiber may range from about 12.5% to about 16.5%.

III. Products Made from Kraft Fibers

The present disclosure provides products made from the modified kraft fiber described herein. In some embodiments, the products are those typically made from standard kraft fiber. In other embodiments, the products are those typically made from cotton linter, pre-hydrolsis kraft or sulfite pulp. More specifically, fiber of the present invention can be used, without further modification, in the production of absorbent products and as a starting material in the preparation of chemical derivatives, such as ethers and esters. Heretofore, fiber has not been available which has been useful to replace both high alpha content cellulose, such as cotton and sulfite pulp, as well as traditional kraft fiber.

Phrases such as "which can be substituted for cotton linter (or sulfite pulp) . . . " and "interchangeable with cotton linter (or sulfite pulp) . . . " and "which can be used in place of cotton linter (or sulfite pulp) . . . " and the like mean only that the fiber has properties suitable for use in the end application normally made using cotton linter (or sulfite pulp or pre-hydrolysis kraft fiber). The phrase is not intended to mean that the fiber necessarily has all the same characteristics as cotton linter (or sulfite pulp).

In some embodiments, the products are absorbent products, including, but not limited to, medical devices, including wound care (e.g. bandage), baby diapers nursing pads, adult incontinence products, feminine hygiene products, including, for example, sanitary napkins and tampons, air-laid non-woven products, air-laid composites, "table-top" wipers, napkin, tissue, towel and the like. Absorbent products according to the present disclosure may be disposable. In those embodiments, fiber according to the invention can be used as a whole or partial substitute for the bleached hardwood or softwood fiber that is typically used in the production of these products.

In some embodiments, the kraft fiber of the present invention is in the form of fluff pulp and has one or more properties that make the kraft fiber more effective than conventional fluff pulps in absorbent products. More specifically, kraft fiber of the present invention may have improved compressibility which makes it desirable as a substitute for currently available fluff pulp fiber. Because of the improved compressibility of the fiber of the present disclosure, it is useful in embodiments which seek to produce thinner, more compact absorbent structures. One skilled in the art, upon understanding the compressible nature of the fiber of the present disclosure, could readily envision absorbent products in which this fiber could be used. By way of example, in some embodiments, the disclosure provides an ultrathin hygiene product comprising the kraft fiber of the disclosure. Ultra-thin fluff cores are typically used in, for example, feminine hygiene products or baby diapers. Other products which could be produced with the fiber of the present disclosure could be anything requiring an absorbent core or a compressed absorbent layer. When compressed, fiber of the present invention exhibits no or no substantial loss of absorbency, but shows an improvement in flexibility.

Fiber of the present invention may, without further modification, also be used in the production of absorbent products including, but not limited to, tissue, towel, napkin and other paper products which are formed on a traditional papermaking machine. Traditional papermaking processes involve the preparation of an aqueous fiber slurry which is typically deposited on a forming wire where the water is thereafter removed. The kraft fibers of the present disclosure may provide improved product characteristics in products including these fibers.

IV. Acid/Alkaline Hydrolyzed Products

In some embodiments, this disclosure provides a modified kraft fiber that can be used as a substitute for cotton linter or sulfite pulp. In some embodiments, this disclosure provides a modified kraft fiber that can be used as a substitute for cotton linter or sulfite pulp, for example in the manufacture of cellulose ethers, cellulose acetates and microcrystalline cellulose.

Without being bound by theory, it is believed that the increase in aldehyde content relative to conventional kraft pulp provides additional active sites for etherification to end-products such as carboxymethylcellulose, methylcellulose, hydroxypropylcellulose, and the like, while simultaneously reducing the viscosity and DP without imparting significant yellowing or discoloration, enabling production of a fiber that can be used for both papermaking and cellulose derivatives.

In some embodiments, the modified kraft fiber has chemical properties that make it suitable for the manufacture of cellulose ethers. Thus, the disclosure provides a cellulose ether derived from a modified kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the modified kraft fiber has chemical properties that make it suitable for the manufacture of cellulose esters. Thus, the disclosure provides a cellulose ester, such as a cellulose acetate, derived from modified kraft fibers of the disclosure. In some embodiments, the disclosure provides a product comprising a cellulose acetate derived from the modified kraft fiber of the disclosure. For example, and not by way of limitation, the cellulose esters of the disclosure may be used in, home furnishings, cigarette filters, inks, absorbent products, medical devices, and plastics including, for example, LCD and plasma screens and windshields.

In some embodiments, the modified kraft fiber of the disclosure may be suitable for the manufacture of viscose. More particularly, the modified kraft fiber of the disclosure may be used as a partial substitute for expensive cellulose starting material. The modified kraft fiber of the disclosure may replace as much as 15% or more, for example as much as 10%, for example as much as 5%, of the expensive cellulose starting materials. Thus, the disclosure provides a viscose fiber derived in whole or in part from a modified kraft fiber as described. In some embodiments, the viscose is produced from modified kraft fiber of the present disclosure that is treated with alkali and carbon disulfide to make a solution called viscose, which is then spun into dilute sulfuric acid and sodium sulfate to reconvert the viscose into cellulose. It is believed that the viscose fiber of the disclosure may be used in any application where viscose fiber is traditionally used. For example, and not by way of limitation, the viscose of the disclosure may be used in rayon, cellophane, filament, food casings, and tire cord.

In some embodiments, the modified kraft of the present disclosure, without further modification, can be used in the manufacture of cellulose ethers (for example carboxymethylcellulose) and esters as a whole or partial substitute for fiber derived from cotton linters and from bleached softwood fibers produced by the acid sulfite pulping process.

In some embodiments, this disclosure provides a modified kraft fiber that can be used as a whole or partial substitute for cotton linter or sulfite pulp. In some embodiments, this disclosure provides a modified kraft fiber that can be used as a substitute for cotton linter or sulfite pulp, for example in the manufacture of cellulose ethers, cellulose acetates, viscose, and microcrystalline cellulose.

In some embodiments, the kraft fiber is suitable for the manufacture of cellulose ethers. Thus, the disclosure provides a cellulose ether derived from a kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the kraft fiber is suitable for the manufacture of cellulose esters. Thus, the disclosure provides a cellulose ester, such as a cellulose acetate, derived from kraft fibers of the disclosure. In some embodiments, the disclosure provides a product comprising a cellulose acetate derived from the kraft fiber of the disclosure. For example, and not by way of limitation, the cellulose esters of the disclosure may be used in home furnishings, cigarette filters, inks, absorbent products, medical devices, and plastics including, for example, LCD and plasma screens and windshields.

In some embodiments, the kraft fiber is suitable for the manufacture of microcrystalline cellulose. Microcrystalline cellulose production requires relatively clean, highly purified starting cellulosic material. As such, traditionally, expensive sulfite pulps have been predominantly used for its production. The present disclosure provides microcrystalline cellulose derived from kraft fiber of the disclosure. Thus, the disclosure provides a cost-effective cellulose source for microcrystalline cellulose production.

The cellulose of the disclosure may be used in any application that microcrystalline cellulose has traditionally been used. For example, and not by way of limitation, the cellulose of the disclosure may be used in pharmaceutical or nutraceutical applications, food applications, cosmetic applications, paper applications, or as a structural composite. For instance, the cellulose of the disclosure may be a binder, diluent, disintegrant, lubricant, tabletting aid, stabilizer, texturizing agent, fat replacer, bulking agent, anticaking agent, foaming agent, emulsifier, thickener, separating agent, gelling agent, carrier material, opacifier, or viscosity modifier. In some embodiments, the microcrystalline cellulose is a colloid.

Other products comprising cellulose derivatives and microcrystalline cellulose derived from kraft fibers according to the disclosure may also be envisaged by persons of ordinary skill in the art. Such products may be found, for example, in cosmetic and industrial applications.

As used herein, "about" is meant to account for variations due to experimental error. All measurements are understood to be modified by the word "about", whether or not "about" is explicitly recited, unless specifically stated otherwise. Thus, for example, the statement "a fiber having a length of 2 mm" is understood to mean "a fiber having a length of about 2 mm."

The details of one or more non-limiting embodiments of the invention are set forth in the examples below. Other embodiments of the invention should be apparent to those of ordinary skill in the art after consideration of the present disclosure.

EXAMPLES

Test Protocols

1. Caustic solubility (R10, S10, R18, S18) is measured according to TAPPI T235-cm00.
2. Carboxyl content is measured according to TAPPI T237-cm98.
3. Aldehyde content is measured according to Econotech Services LTD, proprietary procedure ESM 055B.
4. Copper Number is measured according to TAPPI T430-cm99.
5. Carbonyl content is calculated from Copper Number according to the formula: carbonyl=(Cu. No.−0.07)/0.6, from *Biomacromolecules* 2002, 3, 969-975.
6. 0.5% Capillary CED Viscosity is measured according to TAPPI T230-om99.
7. Intrinsic Viscosity is measured according to ASTM D1795 (2007).
8. DP is calculated from 0.5% Capillary CED Viscosity according to the formula: DPw=−449.6+598.4 ln (0.5% Capillary CED)+118.02 $\ln^2$ (0.5% Capillary CED), from the 1994 Cellucon Conference published in *The Chemistry and Processing Of Wood And Plant Fibrous Materials*, p. 155, woodhead Publishing Ltd, Abington Hall, Abington, Cambridge CBI 6AH, England, J. F. Kennedy, et al, editors.
9. Carbohydrates are measured according to TAPPI T249-cm00 with analysis by Dionex ion chromatography,
10. Cellulose content is calculated from carbohydrate composition according to the formula: Cellulose=Glucan−(Mannan/3), from *TAPPI Journal* 65(12):78-80 1982.
11. Hemicellulose content is calculated from the sum of sugars minus the cellulose content.
12. Fiber length and coarseness is determined on a Fiber Quality Analyzer™ from OPTEST, Hawkesbury, Ontario, according to the manufacturer's standard procedures.
13. DCM (dichloromethane) extractives are determined according to TAPPI T204-cm97.
14. Iron content is determined by acid digestion and analysis by ICP.
15. Ash content is determined according to TAPPI T211-om02.
16. Brightness is determined according to TAPPI T525-om02.
17. CIE Whiteness is determined according to TAPPI Method T560

Example 1

Methods of Preparing Fibers of the Disclosure

Southern pine chips were cooked in a two vessel continuous digester with Lo-Solids® downflow cooking. The white liquor application was 8.42% as effective alkali (EA) in the impregnation vessel and 8.59% in the quench circulation. The quench temperature was 166° C. The kappa no. after digesting was 20.4. The brownstock pulp was further delignified in a two stage oxygen delignification system with 2.98% sodium hydroxide (NaOH) and 2.31% oxygen ($O_2$) applied. The temperature was 98° C. The first reactor pressure was 758 kPa and the second reactor was 372 kPa. The kappa no. was 6.95.

The oxygen delignified pulp was bleached in a 5 stage bleach plant. The first chlorine dioxide stage (D0) was carried out with 0.90% chlorine dioxide ($ClO_2$) applied at a temperature of 61° C. and a pH of 2.4.

The second or oxidative alkaline extraction stage (EOP) was carried out at a temperature of 76° C. NaOH was applied at 0.98%, hydrogen peroxide ($H_2O_2$) at 0.44%, and oxygen ($O_2$) at 0.54%. The kappa no, after oxygen delignification was 2.1.

The third or chlorine dioxide stage (D1) was carried out at a temperature of 74° C. and a pH of 3.3. $ClO_2$ was applied at 0.61% and NaOH at 0.02%. The 0.5% Capillary CED viscosity was 10.0 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 75 ppm $Fe^{+2}$ on pulp at the repulper of the D1 washer. The pH of the stage was 3.3 and the temperature was 80° C. $H_2O_2$ was applied at 0.26% on pulp at the suction of the stage feed pump.

The fifth or final chlorine dioxide stage (D2) was carried out at a temperature of 80° C., and a pH of 3.9 with 0.16% $ClO_2$ applied. The viscosity was 5.0 mPa·s and the brightness was 90.0% ISO.

The iron content was 10.3 ppm, the measured extractives were 0.018%, and the ash content was 0.1%. Additional results are set forth in the Table below.

Example 2

Southern pine chips were cooked in a two vessel continuous digester with Lo-Solids® downflow cooking. The white liquor application was 8.12% as effective alkali (EA) in the impregnation vessel and 8.18% in the quench circulation. The quench temperature was 167° C. The kappa no. after digesting was 20.3. The brownstock pulp was further delignified in a two stage oxygen delignification system with 3.14% NaOH and 1.74% $O_2$ applied. The temperature was 98° C. The first reactor pressure was 779 kPa and the second reactor was 372 kPa. The kappa no. after oxygen delignification was 7.74.

The oxygen delignified pulp was bleached in a 5 stage bleach plant. The first chlorine dioxide stage (D0) was carried out with 1.03% $ClO_2$ applied at a temperature of 68° C. and a pH of 2.4.

The second or oxidative alkaline extraction stage (EOP) was carried out at a temperature of 87° C. NaOH was applied at 0.77%, $H_2O_2$ at 0.34%, and $O_2$ at 0.45%. The kappa no. after the stage was 2.2.

The third or chlorine dioxide stage (D1) was carried out at a temperature of 76° C. and a pH of 3.0. $ClO_2$ was applied at 0.71% and NaOH at 0.11%. The 0.5% Capillary CED viscosity was 10.3 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 75 ppm $Fe^{+2}$ on pulp at the repulper of the D1 washer. The pH of the stage was 3.3 and the temperature was 75° C. $H_2O_2$ was applied at 0.24% on pulp at the suction of the stage feed pump.

The fifth or final chlorine dioxide stage (D2) was carried out at a temperature of 75° C., and a pH of 3.75 with 0.14% $ClO_2$ applied. The viscosity was 5.0 mPa·s and the brightness was 89.7% ISO.

The iron content was 15 ppm. Additional results are set forth in the Table below.

Example 3

Southern pine chips were cooked in a two vessel continuous digester with Lo-Solids® downflow cooking. The white liquor application was 7.49% as effective alkali (EA) in the impregnation vessel and 7.55% in the quench circulation. The quench temperature was 166° C. The kappa no. after digesting was 19.0. The brownstock pulp was further delignified in a two stage oxygen delignification system with 3.16% NaOH and 1.94% $O_2$ applied. The temperature was 97° C. The first reactor pressure was 758 kPa and the second reactor was 337 kPa. The kappa no. after oxygen delignification was 6.5.

The oxygen delignified pulp was bleached in a 5 stage bleach plant. The first chlorine dioxide stage (D0) was carried out with 0.88% $ClO_2$ applied at a temperature of 67° C. and a pH of 2.6.

The second or oxidative alkaline extraction stage (EOP) was carried out at a temperature of 83° C. NaOH was applied at 0.74%, $H_2O_2$ at 0.54%, and $O_2$ at 0.45%. The kappa no. after the stage was 1.8.

The third or chlorine dioxide stage (D1) was carried out at a temperature of 78° C. and a pH of 2.9. $ClO_2$ was applied at 0.72% and NaOH at 0.04%. The 0.5% Capillary CED viscosity was 10.9 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 75 ppm $Fe^{+2}$ on pulp at the repulper of the D1 washer. The pH of the stage was 2.9 and the temperature was 82° C. $H_2O_2$ was applied at 0.30% on pulp at the suction of the stage feed pump.

The fifth or final chlorine dioxide stage (D2) was carried out at a temperature of 77° C. and a pH of 3.47 with 0.14% $ClO_2$ applied. The viscosity was 5.1 mPa·s and the brightness was 89.4% ISO.

The iron content was 10.2 ppm. Additional results are set forth in the Table below.

Example 4—Comparative Example

Southern pine chips were cooked in a two vessel continuous digester with Lo-Solids® downflow cooking. The white liquor application was 8.32% as effective alkali (EA) in the impregnation vessel and 8.46% in the quench circulation. The quench temperature was 162° C. The kappa no. after digesting was 27.8. The brownstock pulp was further delignified in a two stage oxygen delignification system with 2.44% NaOH and 1.91% $O_2$ applied. The temperature was 97° C. The first reactor pressure was 779 kPa and the second reactor was 386 kPa. The kappa no. after oxygen delignification was 10.3.

The oxygen delignified pulp was bleached in a 5 stage bleach plant. The first chlorine dioxide stage (D0) was carried out with 0.94% $ClO_2$ applied at a temperature of 66° C. and a pH of 2.4.

The second or oxidative alkaline extraction stage (EOP) was carried out at a temperature of 83° C. NaOH was applied at 0.89%, $H_2O_2$ at 0.33%, and $O_2$ at 0.20%. The kappa no. after the stage was 2.9.

The third or chlorine dioxide stage (D1) was carried out at a temperature of 77° C. and a pH of 2.9. $ClO_2$ was applied at 0.76% and NaOH at 0.13%. The 0.5% Capillary CED viscosity was 14.0 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 150 ppm $Fe^{+2}$ on pulp at the repulper of the D1 washer. The pH of the stage was 2.6 and the temperature was 82° C. $H_2O_2$ was applied at 1.6% on pulp at the suction of the stage feed pump.

The fifth or final chlorine dioxide stage (D2) was carried out at a temperature of 85° C., and a pH of 3.35 with 0.13% $ClO_2$ applied. The viscosity was 3.6 mPa·s and the brightness was 88.7% ISO.

Each of the bleached pulps produced in the above examples were made into a pulp board on a Fourdrinier type pulp dryer with an airborne Fläkt dryer section. Samples of each pulp were collected and analyzed for chemical composition and fiber properties. The results are shown in Table 1.

The results show that the pulps produced with a low viscosity or $DP_w$ by a combination of increased delignification and an acid catalyzed peroxide stage (Examples 1-3) have lower carbonyl contents than the comparative example with standard delignification and an increased acid catalyzed peroxide stage. The pulp of the present invention exhibits significantly less yellowing when subjected to a caustic-based process such as the manufacture of cellulose ethers and viscose.

Results are set forth in the Table below.

TABLE 1

| Property | units | Exampe 1 | Exampe 2 | Exampe 3 | Comparative example |
|---|---|---|---|---|---|
| R10 | % | 81.5 | 82.2 | 80.7 | 71.6 |
| S10 | % | 18.5 | 17.8 | 19.3 | 28.4 |
| R18 | % | 85.4 | 85.9 | 84.6 | 78.6 |
| S18 | % | 14.6 | 14.1 | 15.4 | 21.4 |
| ΔR | | 3.9 | 3.7 | 3.9 | 7.0 |
| Carboxyl | meq/100 g | 3.14 | 3.51 | 3.78 | 3.98 |
| Aldehydes | meq/100 g | 1.80 | 2.09 | 1.93 | 5.79 |
| Copper No. | | 1.36 | 1.1 | 1.5 | 3.81 |
| Calculated Carbonyl* | mmole/100 g | 2.15 | 1.72 | 2.38 | 6.23 |
| CED Viscosity | mPa · s | 5.0 | 5.1 | 5.0 | 3.6 |
| Intrinsic Viscosity | [h] dl/g | 3.58 | 3.64 | 3.58 | 2.52 |
| Calculated DP*** | $DP_w$ | 819 | 839 | 819 | 511 |
| Glucan | % | 83.5 | 84.3 | 84.7 | 83.3 |
| Xylan | % | 7.6 | 7.4 | 6.6 | 7.6 |
| Galactan | % | <0.1 | 0.2 | 0.2 | 0.1 |
| Mannan | % | 6.3 | 5.0 | 4.1 | 6.3 |
| Arabinan | % | 0.4 | 0.2 | 0.3 | 0.2 |

TABLE 1-continued

| Property | units | Exampe 1 | Exampe 2 | Exampe 3 | Comparative example |
|---|---|---|---|---|---|
| Calculated Cellulose** | % | 81.4 | 82.6 | 83.3 | 81.2 |
| Calculated Hemicelllulose | % | 16.5 | 14.5 | 12.6 | 16.3 |

Example 5—Test for Yellowing

Dried pulp sheets from Example 2 and the comparative example were cut into 3"×3" squares. The brightness and color values as CIE L*, a*, b* coordinates were determined on a Hunterlab MiniScan™ XE instrument. Each of the squares was placed separately in a tray and 30 mls of 18% NaOH was added to saturate the sheet. The square was removed from the tray and NaOH solution after 5 minutes. The brightness and color values were measured on the saturated sheet.

The L*, a*, b* system describes a color space as:

L*=0 (black)-100 (white)

a*=−a (green)-+a (red)

b*=−b (blue)-+b (yellow)

The results are shown in Table 2. The pulp of example 2 exhibits significantly less yellowing as seen in the smaller b* value for the saturated sample and in the smaller increase of the b* value upon saturation.

TABLE 2

Properties of Initial and NaOH Saturated Pulps

| | initial | NaOH saturated sample | Δ |
|---|---|---|---|
| Comparative example | | | |
| L* | 95.42 | 67.7 | 27.72 |
| a* | −0.44 | 1.17 | −1.61 |
| b* | 5.55 | 44.71 | −39.16 |
| Brightness | 81.76 | 13.4 | 68.36 |
| Comparative example | | | |
| L* | 96.5 | 71.86 | 24.65 |
| a* | −0.88 | −2.26 | 1.38 |
| b* | 3.39 | 38.72 | −35.34 |
| Brightness | 87.03 | 19.50 | 67.54 |
| Example 2 | | | |
| L* | 95.84 | 74.52 | 21.32 |
| a* | −0.35 | −2.83 | 2.48 |
| b* | 4.23 | 21.62 | −17.39 |
| Brightness | 84.32 | 31.88 | 52.44 |
| Example 3 | | | |
| L* | 96.31 | 73.8 | 22.51 |
| a* | −0.81 | −2.78 | 1.97 |
| b* | 3.67 | 22.36 | −18.69 |
| Brightness | 86.21 | 29.39 | 56.82 |
| Example 6 | | STD. FLUFF | |
| L* | 96.82 | 75.31 | 21.51 |
| a* | −1.04 | −1.99 | 0.95 |
| b* | 3.5 | 10.41 | −6.9 |
| Brightness | 87.69 | 40.67 | 47.02 |

Example 6—Standard Fluff Pulp

Southern pine chips were cooked in a two vessel continuous digester with Lo-Solids® downflow cooking. The white liquor application was 8.32% as effective alkali (EA) in the impregnation vessel and 8.46% in the quench circulation. The quench temperature was 162° C. The kappa no. after digesting was 27.8. The brownstock pulp was further delignified in a two stage oxygen delignification system with 2.44% NaOH and 1.91% $O_2$ applied. The temperature was 97° C. The first reactor pressure was 779 kPa and the second reactor was 386 kPa. The kappa no. after oxygen delignification was 10.3.

The oxygen delignified pulp was bleached in a 5 stage bleach plant. The first chlorine dioxide stage (D0) was carried out with 0.94% $ClO_2$ applied at a temperature of 66° C. and a pH of 2.4.

The second or oxidative alkaline extraction stage (EOP) was carried out at a temperature of 83° C. NaOH was applied at 0.89%. $H_2O_2$ at 0.33%, and $O_2$ at 0.20%. The kappa no. after the stage was 2.9.

The third or chlorine dioxide stage (D1) was carried out at a temperature of 77° C. and a pH of 2.9. $ClO_2$ was applied at 0.76% and NaOH at 0.13%. The 0.5% Capillary CED viscosity was 14.0 mPa·s.

The fourth stage (EP) was a peroxide reinforced alkaline extraction stage. The pH of the stage was 10.0 and the temperature was 82° C. NaOH was applied at 0.29% on pulp. $H_2O_2$ was applied at 0.10% on pulp at the suction of the stage feed pump.

The fifth or final chlorine dioxide stage (D2) was carried out at a temperature of 85° C., and a pH of 3.35 with 0.13% $ClO_2$ applied. The viscosity was 13.2 mPa·s and the brightness was 90.9% ISO.

A number of embodiments have been described. Nevertheless, it will be understood that various modifications may be made without departing from the spirit and scope of the disclosure. Accordingly, other embodiments are within the scope of the following claims.

We claim:

1. An oxidized bleached softwood kraft fiber exhibiting: a total carbonyl content of less than about 2.5 mmoles/100 g and a CED viscosity of less than about 5 mPa·s.

2. The fiber of claim 1, wherein the fiber has a b* value in the NaOH saturated state of less than 30.

3. The fiber of claim 1, wherein the fiber has a Δb* of less than about 25.

4. The fiber of claim 1, wherein the total carbonyl content ranges from about 1.5 mmoles/100 g to about 2.5 mmoles/100 g.

5. The fiber of claim 1, further exhibiting a hemicellulose content from about 12% to about 17%.

6. The fiber of claim 1, further exhibiting a brightness from about 85 to about 92.

7. The fiber of claim 1, further exhibiting a carboxyl content ranging from about 2 meq/100 g to about 4 meq/100 g.

8. The fiber of claim 1, exhibiting a total carbonyl content ranging from about 1.5 mmol/100 g to about 2.5 mmol/100 g, a CED viscosity of less than about 5 mPa·s, a hemicellulose content from about 12% to about 17%, a brightness from about 85 to about 92, and a carboxyl content ranging from about 2 meq/100 g to about 4 meq/100 g.

9. Microcrystalline cellulose made from the fiber of claim 1.

10. Viscose made from the fiber of claim 1.

11. Cellulose ether made from the fiber of claim 1.

* * * * *